US006544064B1

(12) United States Patent
McHugh et al.

(10) Patent No.: US 6,544,064 B1
(45) Date of Patent: Apr. 8, 2003

(54) SOCKET CONNECTOR AND METHOD FOR MAKING SAME

(75) Inventors: Robert G. McHugh, Golden, CO (US); Hsiu-Yuan Hsu, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/033,345

(22) Filed: Dec. 26, 2001

(51) Int. Cl.[7] ..... H01R 13/625
(52) U.S. Cl. ..... 439/342; 439/83
(58) Field of Search ..... 439/342, 83, 876

(56) References Cited

U.S. PATENT DOCUMENTS

| | | | | | |
|---|---|---|---|---|---|
| 4,498,725 | A | * | 2/1985 | Bright et al. | |
| 5,833,483 | A | * | 11/1998 | Lai et al. | 439/342 |
| 5,947,778 | A | * | 9/1999 | Lai et al. | 439/342 |
| 6,059,596 | A | * | 5/2000 | Pei et al. | 439/342 |
| 6,086,401 | A | * | 7/2000 | Hsiung et al. | 439/342 |
| 6,142,810 | A | * | 11/2000 | Hsiao et al. | 439/342 |
| 6,159,032 | A | * | 12/2000 | McHugh et al. | 439/342 |
| 6,186,816 | B1 | * | 2/2001 | Lu et al. | 439/83 |
| 6,231,367 | B1 | * | 5/2001 | Hsiao et al. | 439/83 |
| 6,241,535 | B1 | * | 6/2001 | Lemke et al. | 439/83 |

* cited by examiner

*Primary Examiner*—Gary Paumen
(74) *Attorney, Agent, or Firm*—Wei Te Chung

(57) ABSTRACT

A socket connector includes a base housing defining cavities, and contact elements positioned in the cavities. Each cavity has a first channel extending in a given direction and a second channel oblique with respect to and in communication with the first channel. Each contact element includes a retention section retained in the cavity and oblique with respect to the given direction. The contact element has a cantilever beam somewhat compliant with the given direction. A pin leg of an electronic package is initially received in the second channel of the cavity and movable in the given direction toward and biasingly engaging the cantilever beam. The contact element has a straight tail extending beyond the housing with a mass of solder attached thereto for soldering to a circuit board. A slot is defined in the tail for securely retaining the solder. A method for making the connector includes the steps of (1) providing a base housing defining cavities having first and second channels oblique with respect to each other; (2) forming a row of contact elements connected to a carrier strip by connection sections; (3) twisting the connection sections to obliquely orient the contact elements with respect to the carrier strip; and (4) gang loading the contact elements into the cavities with the cantilever beams of the contact element somewhat complaint with the given direction.

14 Claims, 9 Drawing Sheets

SOCKET CONNECTOR AND METHOD FOR MAKING SAME

BACKGROUND OF THE INVENTION

1. Field of the Invention

The present invention generally relates to a socket connector having conductive contact elements for electrically connecting an electronic package, such as a central processing unit (CPU) module, to a circuit board, and more particular to a socket connector having compactly arranged contact elements. A method for making the socket connector is also disclosed.

2. The Related Arts

Socket connectors for mounting an electronic package, such as a central processing unit (CPU) module, to a circuit board are well known and commonly used in the computer industry. FIG. 1 of the attached drawings shows an example of the socket connectors that is referred to as ZIF (Zero Insertion Force) socket connector. The socket connector, generally designated with reference numeral 10, comprises a dielectric base housing 12 defining an array of cavities 14 open to a top face 15 of the base housing 12. A dielectric cover 16 rests on the top face 15 of the base housing 12 and is movable across the top face 15 of the base housing 12 in a given moving direction A. The cover 16 defines through holes 18 corresponding to the open cavities 14 of the base housing 12. The cover 16 carries an electronic package 20 having depending pin legs 22 extending through the holes 18 and partially projecting into the cavities 14. An actuator 24 drives the cover 16 in the moving direction for bringing the pin legs 24 into contact with conductive contact elements 26 received and retained in the base housing 12 thereby forming electrical connection therebetween. Examples of socket connectors of this type are disclosed in U.S. Pat. Nos. 4,498,725, 5,833,483, 6,059,596, 6,142,810, and 6,159,032.

U.S. Pat. No. 4,988,310 also discloses a socket connector of this type. The device of the '310 patent comprises a base housing 12 defining cavities 14 each receiving a contact element having a single beam. An example of the single-beam contact element is shown in FIG. 2 of the attached drawings wherein a contact element 26 is stamped from a metal plate (not shown) and remains attached to a carrier strip 28 after stamping. The carrier strip 28 carries a number of contact elements 26 for simultaneously fitting the contact elements 26 into the cavities 14 of the base housing 12. The carrier strip 28 is then removed to complete the manufacture of the connector.

Each contact element 26 comprises a retention section 30 retained in the cavity 14 of the base housing 12 and a post 32 extending beyond the base housing 12 for being soldered to a circuit board (not shown). An intermediate section 34 extends from the base section 30 and is substantially opposite to the post 32. The intermediate section 34 has a distal free end 36 from which a cantilever beam 38 extends for biasingly engaging the pin leg 22 of the electronic package 20.

Also referring to FIG. 3, the cantilever beam 38 comprises a free end portion 40 and an oblique portion 42 connected to the intermediate section 34 and the free end portion 40 by two bend portions 44 whereby the free end portion 40 is substantially parallel to but offset from the distal end 36 of the intermediate section 34 a distance determined by the oblique portion 42.

The cavity 14 of the base housing 12 that receives the contact element 26 has a side wall 46 parallel to and opposite to the free end portion 40 of the cantilever beam 38 with a gap therebetween. The pin leg 22 is initially received in the cavity 14 at a position corresponding to the distal end 36 of the intermediate section 34 and is moved in the moving direction A under the guidance of the oblique portion 42 into the gap between the free end portion 40 and the side wall 46. The cantilever beam 38 is deflected as shown in dashed lines and thus biasingly engages the pin leg 22.

A disadvantage of the conventional contact elements is that the contact elements 26 must be lined up and in registration with each other because the cantilever beam 38 extends in a direction substantially parallel to the moving direction A of the pin leg 22. The pitch between adjacent cavities 14 of the base housing 12 must be at least greater than the length of the cantilever beam 38. In addition, due to the need of the oblique portion 42 for biasingly engaging the free end portion 44 with the pin leg 22, the overall length of the cantilever beam 38 cannot be effectively reduced. Thus, the overall size of the socket connector with the same arrangement and same number of contact elements cannot be reduced and the contact elements cannot be arranged in a compact manner.

Thus, a socket connector that allows the contact elements to be compactly arranged is desired.

SUMMARY OF THE INVENTION

An object of the present invention is to provide a socket connector having compactly arranged contact elements.

Another object of the present invention is to provide a method for manufacturing a socket connector having compactly arranged contact elements.

To achieve the above objects, in accordance with the present invention, a socket connector comprises a base housing defining cavities and contact elements positioned in the cavities. Each cavity has a first channel extending in a given direction and a second channel oblique with respect to and in communication with the first channel. Each contact element comprises a retention section retained in the cavity and oblique with respect to the given direction. The contact element comprises a cantilever beam somewhat complaint with the given direction. A pin leg of an electronic package is initially received in the second channel of the cavity and movable in the given direction toward and biasingly engaging the cantilever beam. The contact element comprises a straight tail extending beyond the housing with a mass of solder attached thereto for soldering to a circuit board. A slot is defined in the tail for securely retaining the solder.

A method for making the socket connector of the present invention comprises the steps of (1) providing a base housing defining cavities having first and second channels oblique with respect to each other; (2) forming a row of contact elements connected to a carrier strip by connection sections; (3) twisting the connection sections to obliquely orient the contact elements with respect to the carrier strip; and (4) gang loading the contact elements into the cavities with the cantilever beams of the contact element somewhat compliant with the given direction.

BRIEF DESCRIPTION OF THE DRAWINGS

The present invention will be apparent to those skilled in the art by reading the following description of a preferred embodiment thereof and the best mode for carrying out the invention, with reference to the attached drawings, in which.

DETAILED DESCRIPTION OF THE PREFERRED EMBODIMENT

Figure 1:
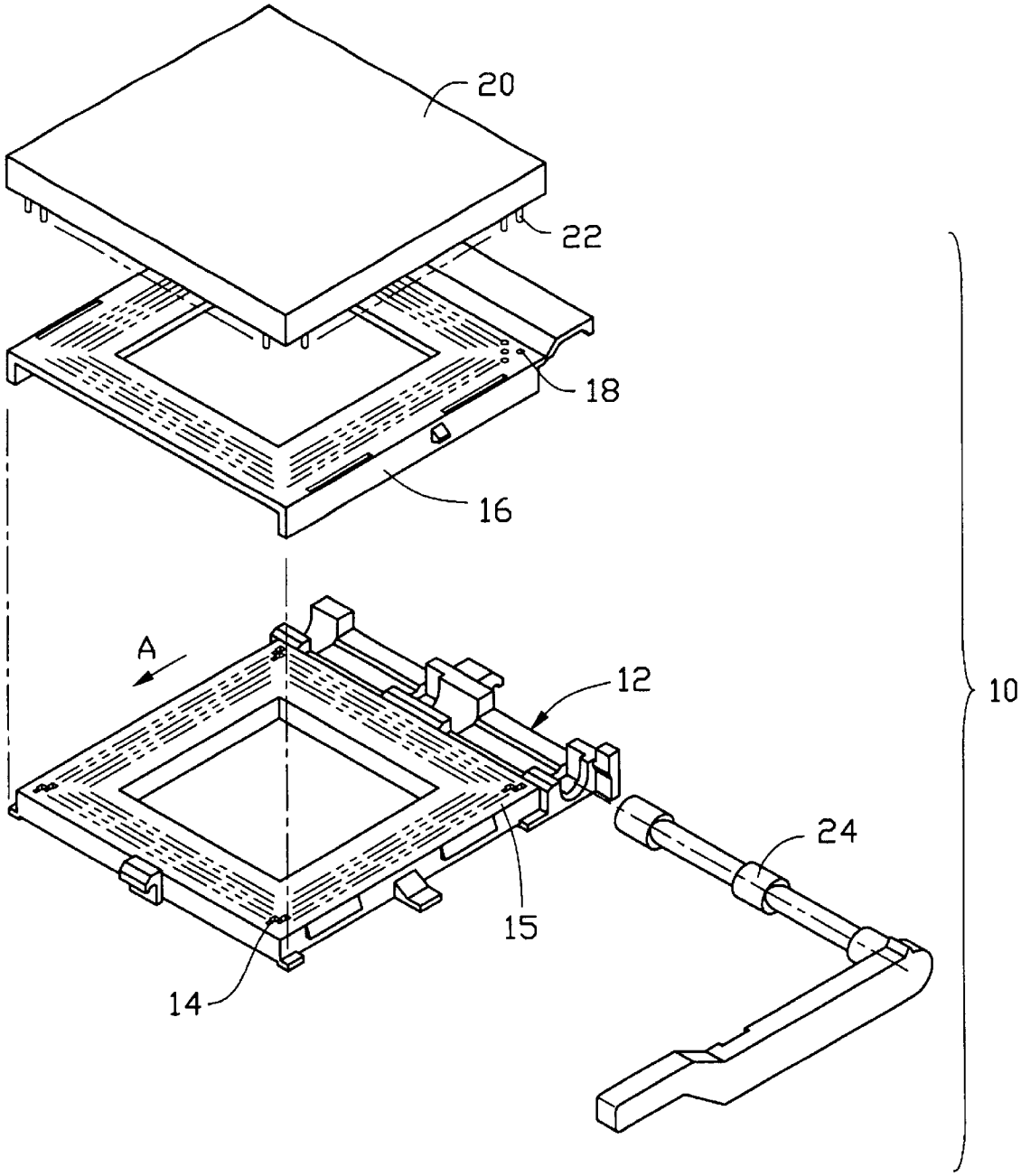
FIG. 1 (PRIOR ART)
FIG. 1 is an exploded view of a conventional socket connector.
Figure 2:
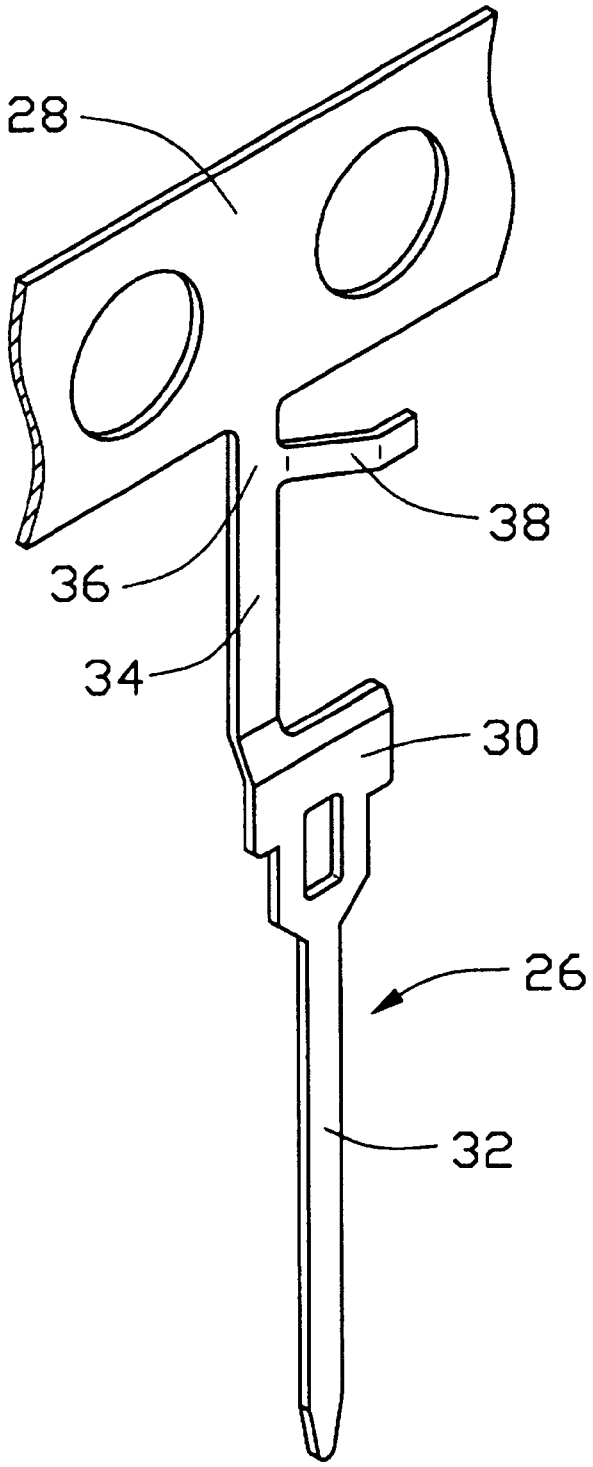
FIG. 2 (PRIOR ART)
FIG. 2 is a perspective view showing a conventional contact element attached to a carrier strip.
Figure 3:
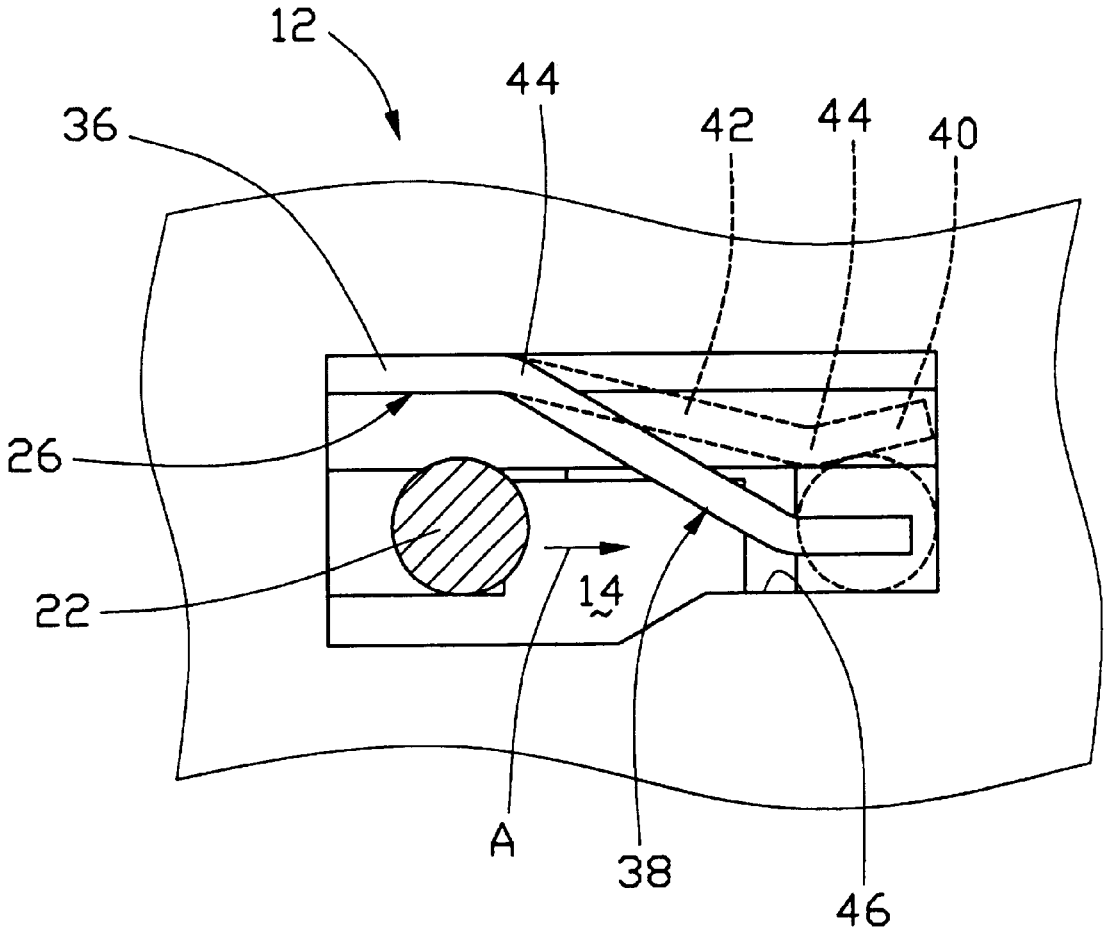
FIG. 3 (PRIOR ART)
FIG. 3 is a top view of a portion of a base housing of the socket connector with the conventional contact element received in a cavity defined in the base housing, illustrating the movement of a pin leg therein.
Figure 4:
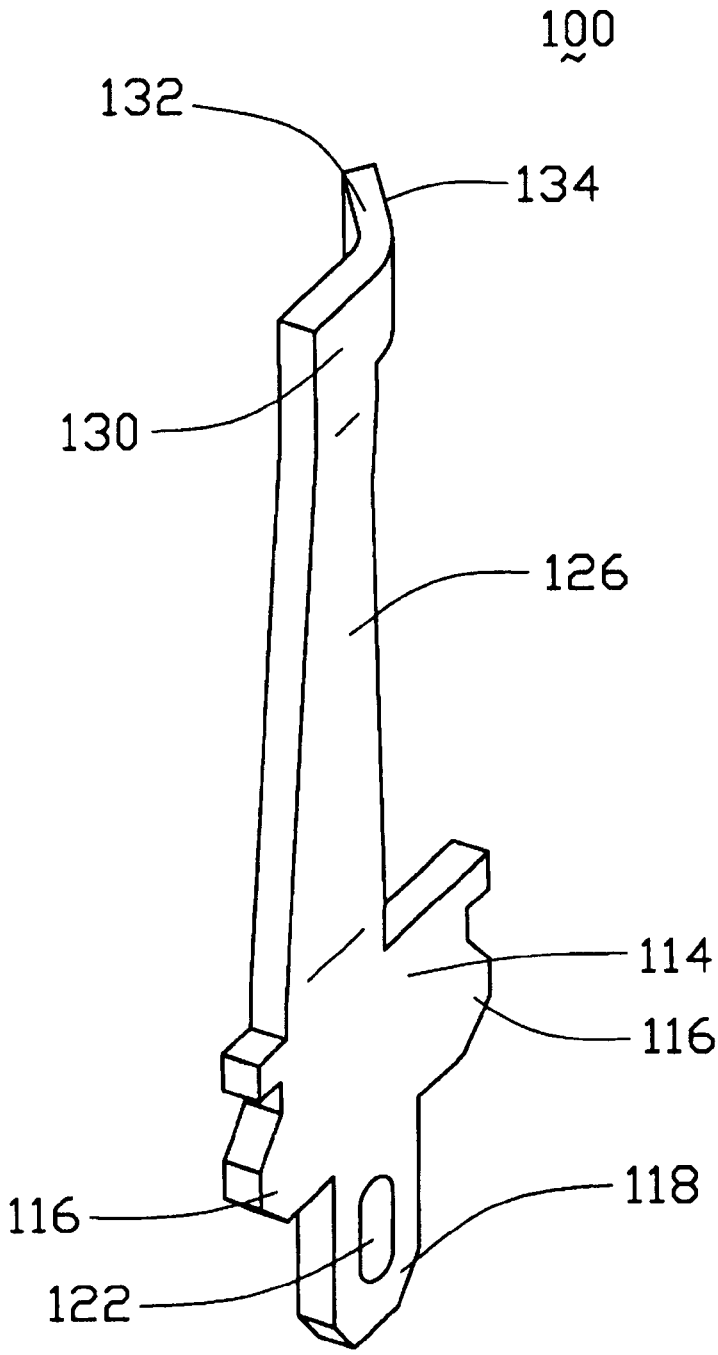
FIG. 4 is a perspective view of a contact element constructed in accordance with the present invention.
Figure 5:
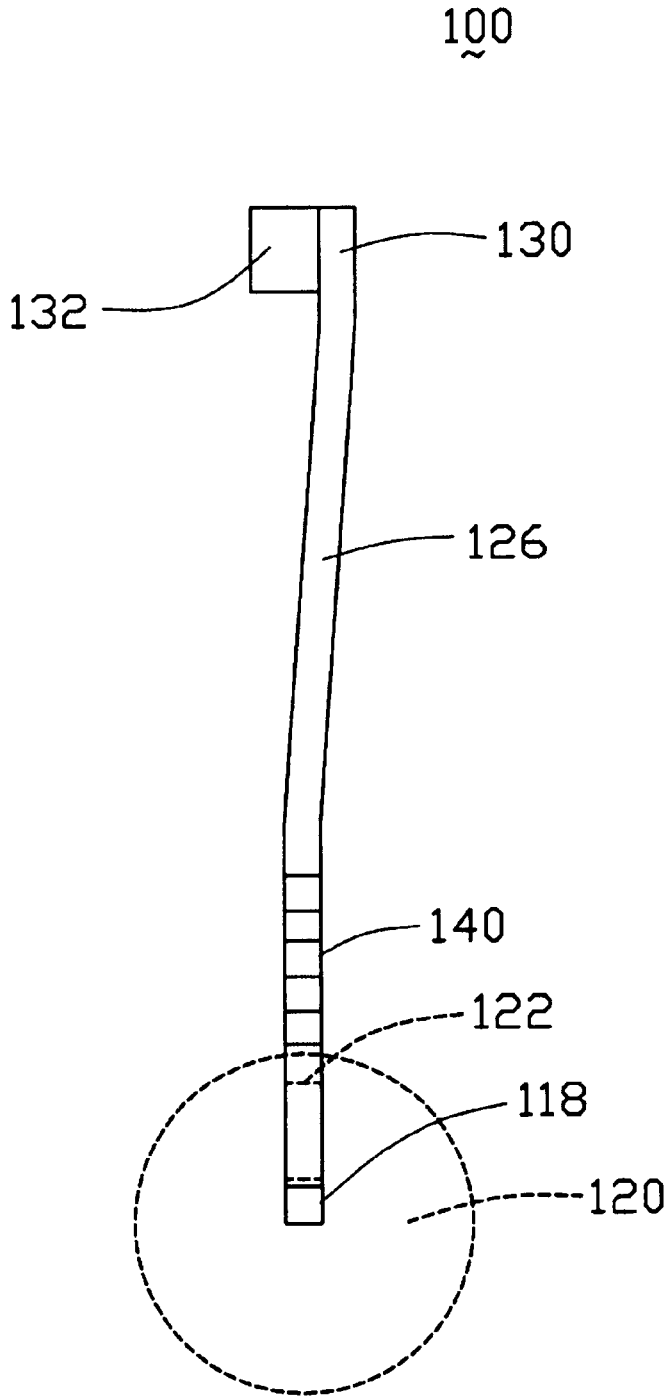
FIG. 5 is a side elevational view of the contact element of the present invention with a mass of solder attached to a tail thereof.

With reference to the drawings and in particular to FIGS. 4–8, a contact element constructed in accordance with the present invention, generally designated with reference numeral 100, is received and retained in a cavity 102 defined in a base housing 104 of a socket connector. It is noted that FIG. 7 only shows a portion of the base housing 104. The cavity 102 is open to a top face 106 of the base housing 104 and has a substantially closed bottom 108. A slit 110 exposed to a bottom face 112 of the base hosing 104 is defined in the bottom 108 of the cavity 102.

The contact element 100 is made by stamping a metal plate (not shown), followed by forming and other operations. The contact element 100 comprises a retention section 114 having opposite barbed side edges 116 inteferentially engaging the slit 110 to securely retain the contact element 100 in the cavity 102. A tail section 118 extends from a lower edge of the retention section 114 beyond the bottom face 112 of the base housing 104. A mass of solder 120 can be attached to the tail section 118 after the tail section 118 extends beyond the bottom face 112 of the base housing 104 for connecting the contact element 100 to a circuit board (not shown). To more securely retain the solder 120, a slot 122 is defined in the tail section 118. A portion of the solder 120 can be received in the slot 122 to secure the solder 120 to the tail section 118. In addition, a recess 124 is defined in the bottom face 112 of the base housing 104 for partially accommodating the solder 120. The slit 110 defined in the bottom 108 of the cavity 102 is in communication with the recess 124 for the extension of the tail section 118.

It is noted that the tail section 118 is substantially coplanar with the retention section 114. However, the tail section 118 can be modified by forming a neck (not shown) between the tail section 118 and the retention section 114. The neck is then bent an angle, such as 90 degree. Alternatively and apparent to those skilled in the art, the tail section 118 can be modified to be a "through-hole" type tail that extends through a hole defined in the circuit board.

Figure 9:
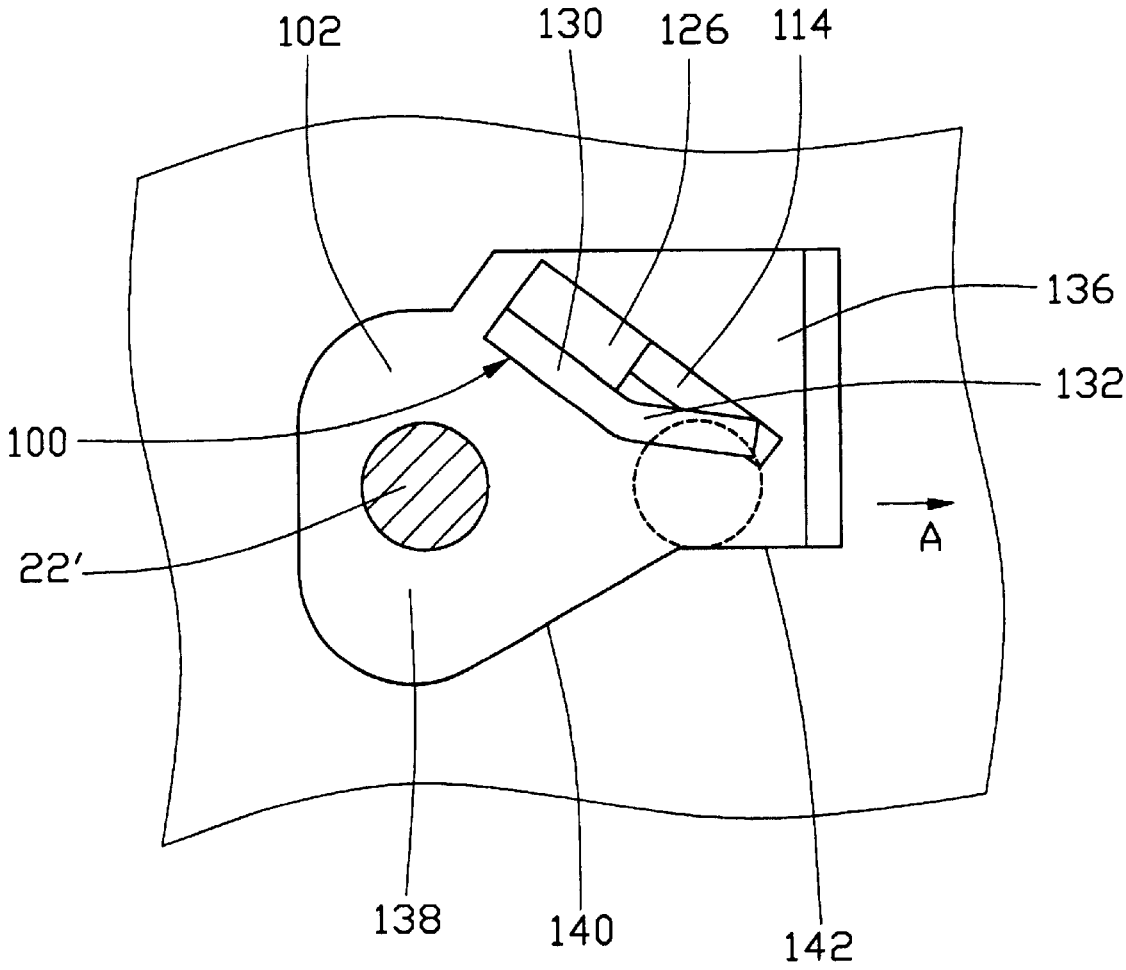
FIG. 9 is a top view of a portion of the base housing, illustrating the movement of a pin leg in the cavity of the base housing of the present invention.

The contact element 100 further comprises an elongate intermediate section 126 extending from a top edge (not labeled) of the retention section 114 in a direction opposite to the tail section 118. The intermediate section 126 has a free end portion 130 from which a cantilever beam 132 extends in a direction substantially normal to the length of the intermediate section 126 whereby the cantilever beam 132 is substantially spaced from the retention section 114. The cantilever beam 132 has a major surface 134 for contacting and biasingly engaging a pin leg 22' of an electronic package (FIG. 9). The major surface 134 of the cantilever beam 132 is oblique to the free end portion 130 of the intermediate section 126 at a predetermined angle. This will be further discussed.

Also referring to FIG. 9, in order to reduce the distance between two contact elements 100 received in adjacent cavities 102 of the base housing 104, according to the present invention, the slit 110 of each cavity 102 is arranged oblique with respect to a moving direction A of the pin leg 22' whereby the retention section 114 of the contact element 100 received in the slit 110 is similarly oblique with respect to the moving direction A and so is the free end portion 130 of the intermediate section 126. The oblique angle of the cantilever beam 132 with respect to the free end portion 130 of the intermediate section 126 is chosen so that the cantilever beam 132 is somewhat compliant with the moving direction A whereby the free end portion 130 of the intermediate section 126 functions as a lead-in for guiding the pin leg 22' in the moving direction A toward the cantilever beam 132. A biasing engagement is thus formed between the pin leg 22' (shown in dashed lines) and the cantilever beam 132.

The cavity 102 of the base housing 104 has a first channel 136 having an axis (not labeled) substantially parallel to the moving direction A and a second channel 138 having an axis oblique with respect to the first axis at an angle. Preferably the oblique angle of the second axis with respect to the first axis is substantially corresponding to the oblique angle of the cantilever beam 132 with respect to the free end portion 130 of the intermediate section 126. The second channel 138 has a side wall 140 substantially opposite to and partially symmetric with respect to the free end portion 130 of the intermediate section 126 whereby the free end portion 130 and the side wall 140 are convergent toward each other for guiding the movement of the pin leg 22' in the moving direction A. The first channel 136 has a side wall 142 opposite to the cantilever beam 132 with a gap G therebetween. The gap G is sized to have the cantilever beam 132 biasingly engaged by the pin leg 22' when the pin leg 22' is moved into the gap G.

Due to the oblique arrangement of the contact element 100 with respect to the moving direction A of the pin leg 22', the space occupied by the contact element 100 is effectively reduced. The distance (pitch) between adjacent contact elements 100 can be shortened, thus allowing a compact arrangement of the contact elements 100 in the base housing 104. Due to the oblique arrangement of the second channel 138, the pin leg 22' can be initially inserted into the cavity 102 in a substantially zero insertion force manner and the pin leg 22' can be guided into the gap G smoothly.

Figure 6:
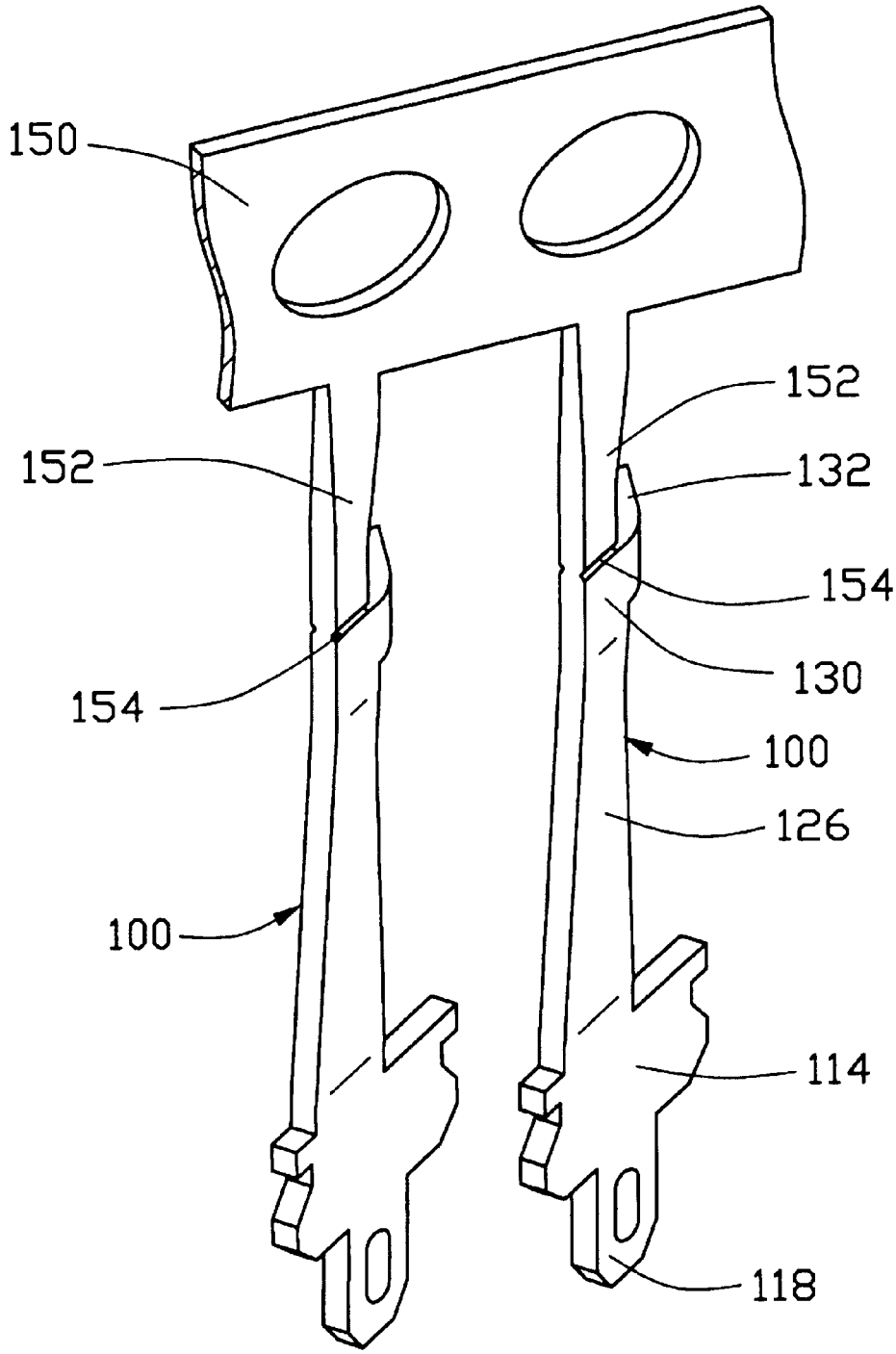
FIG. 6 is a perspective view showing a carrier strip to which a number of the contact elements of the present invention are attached before the contact elements are loaded into cavities defined in the base housing of a socket connector.
Figure 7:
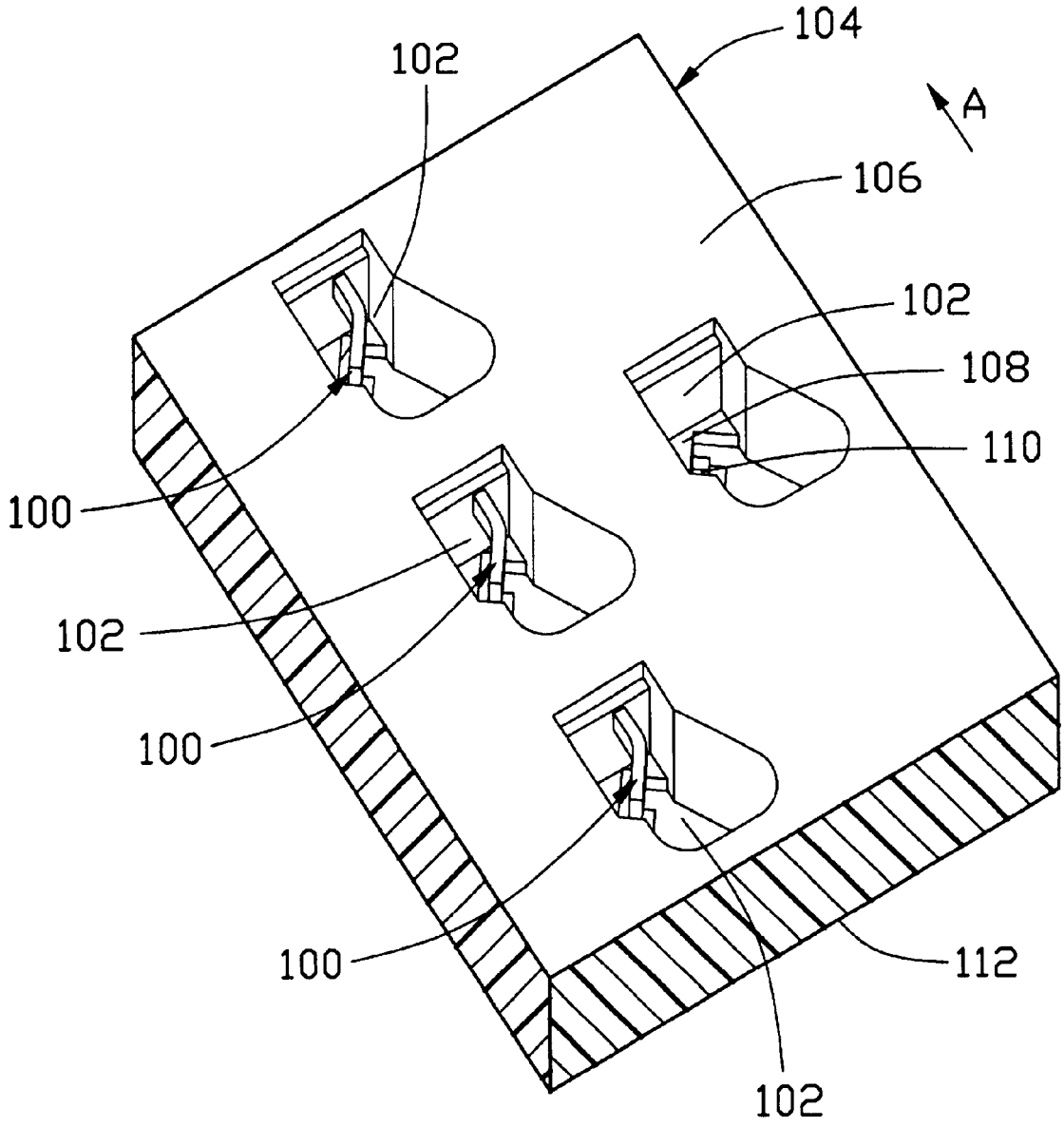
FIG. 7 is a perspective view of a portion of the base housing of a socket connector taken from a top side of the base housing, showing the contact elements of the present invention received in cavities defined in the base housing.
Figure 8:
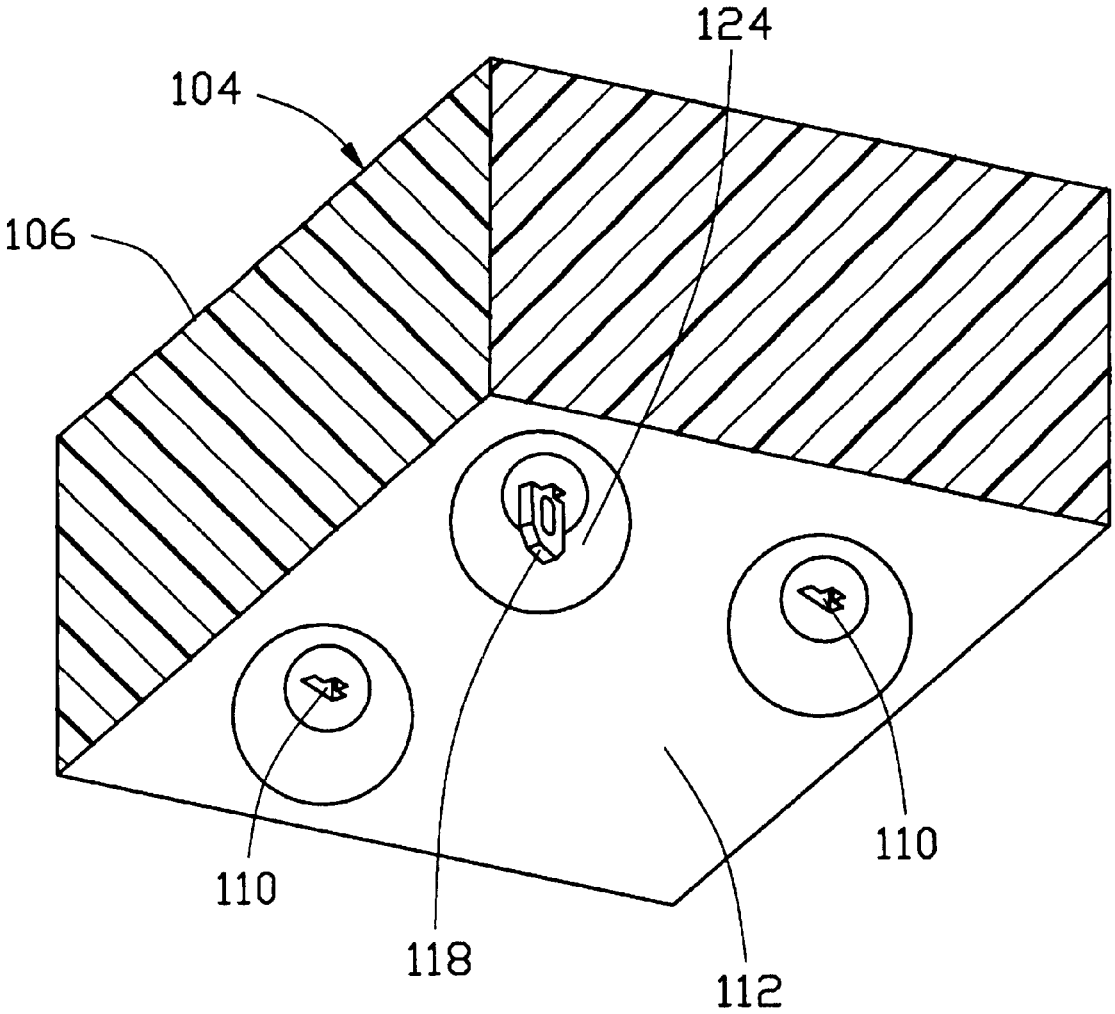
FIG. 8 is a perspective view, taken from a bottom side, of a portion of the base housing of the socket connector in which the contact elements are received.

Particularly referring to FIG. 6, the contact elements 100 is made by stamping a metal plate (not shown), followed by forming and other operations. The contact elements 100 so made are attached to a carrier strip 150 that partly constitutes the metal plate by respective slender connection sections 152. To simultaneously load a row of contact elements 100 into the corresponding cavities 102 of the base housing 104 in an oblique manner, the connection section 152 is twisted to obliquely orient the retention section 114 of each contact element 100 with respect to the carrier strip 150. The twist angle of the connection section 152 substantially corresponds to the oblique angle of the slit 110 of the corresponding cavity 102 . The carrier strip 150 is properly positioned with respect to the base housing 102 (namely the carrier strip 150 is substantially parallel to the moving direction A) whereby the retention sections 114 of the contact elements 100 are in registration with the slits 110 of the corresponding cavities 102. The contact elements 100 are then put into the cavities 102 whereby a gang loading of a row of contact elements 100 is achieved. The contact elements 100 are separated from the carrier strip 150 along a weakened portion 154 of each connection section 152.

Although the present invention has been described with reference to the preferred embodiment thereof and the best mode for carrying out the invention, it is apparent to those skilled in the art that a variety of modifications and changes may be made without departing from the scope of the present invention which is intended to be defined by the appended claims.

What is claimed is:

1. A socket connector comprising:

a base housing having top and bottom faces, the housing defining cavities that are open to the top face adapted to receive a pin leg of an electronic package that is movable in a moving direction toward an engaged position, each cavity having a substantially closed bottom with a slit defined therein and exposed to the bottom face of the housing, the slit being oriented oblique with respect to the moving direction at a predetermined oblique angle;

a conductive contact element received in each cavity, the contact element comprising a retention section received and retained in the slit of the cavity whereby the contact element is substantially oblique with respect to the moving direction, an intermediate section extending from the retention section toward the top opening of the cavity, a cantilever beam extending from the intermediate section and substantially spaced from the retention section, the cantilever beam being oblique with respect to the contact element and somewhat compliant with the moving direction of the pin leg and adapted to biasingly engage the pin leg when the pin leg is moved to the engaged position.

2. The socket connector as claimed in claim 1 further comprising a cover movably supported on the top face of the base housing, the cover being adapted to carry the electronic package and movable in the moving direction to drive the pin leg toward the engaged position.

3. The socket connector as claimed in claim 1, wherein the contact element comprises a tail section extending from the retention section through the slit for electrically engaging a circuit board.

4. The socket connector as claimed in claim 3, wherein the tail section is substantially coplanar with the retention section.

5. The socket connector as claimed in claim 3, wherein a mass of solder is attached to the tail section of the contact element.

6. The socket connector as claimed in claim 5, wherein a slot is defined in the tail section for securely retaining the solder on the tail section.

7. A socket connector comprising a base housing having a bottom face and defining cavities receiving conductive contact elements therein, each cavity having a substantially closed bottom with a slit defined therein and exposed to the bottom face of the base housing, each contact element having a retention section partially received and retained in the slit and a tail section extending through the slit, the tail section being coplanar with the retention section, a slot being defined in the tail section for attaching a mass of solder thereto, the solder being located outside the housing.

8. The socket connector as claimed in claim 7, wherein a recess is defined in the bottom face of the base housing with the slit in communication therewith, the recess being adapted to partially accommodate the mass of solder with the mass of the solder partially projecting beyond the bottom face of the base housing.

9. A socket connector comprising:

a base housing defining cavities each comprising a first channel extending in a first direction and a second channel extending in a second direction, the first and second channels being communication with each other, the first channel having a first side wall substantially parallel to the first direction, the second channel having a second side wall substantially parallel to the second direction, the second direction being oblique with respect to the first direction whereby the second side wall is oblique with respect to the first side wall; and a conductive contact element received in each cavity, the contact element comprising a first, resilient portion spaced from the first side wall with a gap defined therebetween, and a second portion substantially opposite to the second side wall, the second portion and the second side wall being convergent to each other toward the first portion and first side wall whereby the second side wall and the second portion of the contact element functioning as lead-in adapted to guide a pin leg of an electronic package into the gap with the pin leg biasingly engaged by the first portion of the contact element.

10. A method for manufacturing an electrical connector comprising the following steps:

(1) providing a base housing having top and bottom faces, at least a row of cavities being formed in the housing and each having an opening defined in the top face, a slit being defined in a closed bottom of each cavity and oblique with respect to a given direction;

(2) forming a row of conductive contact elements, each connected to a carrier strip by a connection section, each contact element being initially parallel to the carrier strip;

(3) twisting the connection section of each contact element to obliquely orient the contact element with respect to the carrier strip; and (4) gang loading the row of the contact elements into the row of the cavities through the top openings of the cavities with the carrier strip substantially parallel to the given direction, the contact elements being retained in the slits whereby the contact elements are substantially oblique with respect to the given direction.

11. The method as claimed in claim 10 further comprising a stop of removing the carrier strip from the contact elements.

12. The method as claimed in claim 10, wherein in step (4), each contact element has a portion somewhat compliant with the given direction.

13. The method as claimed in claim 10, wherein each contact element comprises a tail extending beyond the base housing and further comprising a step of attaching a mass of solder to the tail.

14. A socket connector assembly comprising:

a base housing defining opposite top and bottom faces;

a plurality of cavities defined in the housing extending through the top face and terminating at said bottom faces with a slit in downward communication with an exterior;

a CPU pin inserted into each of said cavities and moveable along a direction;

said slit being oblique relative to said direction;

each of said cavities defining thereof a side wall;

a conductive contact element received in each of said cavities, said contact element including a retention section retained in the corresponding slit, an intermediate section upwardly extending from said retention section, with a deflected angle relative to a plane defined by said retention section, toward a center of the corresponding cavity, a cantilever beam horizontally extending from a top of said intermediate section in a tilting manner with regard to a length direction of the corresponding cavity; wherein when the CPU pin is sandwiched between said cantilever beam and the corresponding side wall, said intermediate section outwardly deflected away from the center of the cavity.

* * * * *